United States Patent [19]

Vogelgesang

[11] 4,411,170

[45] Oct. 25, 1983

[54] WIRE ROLLING MILL IN BLOCK FORM, A SO-CALLED WIRE BLOCK WITH AT LEAST ONE DRIVEN LINE SHAFT

[75] Inventor: Herbert Vogelgesang, St.-Ingbert, Fed. Rep. of Germany

[73] Assignee: Mannesmann Aktiengesellschaft, Dusseldorf, Fed. Rep. of Germany

[21] Appl. No.: 252,933

[22] Filed: Apr. 10, 1981

[51] Int. Cl.[3] ..... F16H 37/06

[52] U.S. Cl. ..... 74/661; 74/378; 74/665 M; 72/234; 72/249

[58] Field of Search ..... 74/665 L, 665 M, 665 Q, 74/665 G, 665 F, 665 H, 665 GB, 664, 661, 645, 655, 378, 191, 206, 207, 202, 211; 72/234, 249

[56] References Cited

U.S. PATENT DOCUMENTS

| | | | |
|---|---|---|---|
| 744,178 | 11/1903 | Dresser | 74/665 Q |
| 1,206,003 | 11/1916 | Landry | 74/665 GB |
| 1,466,642 | 8/1923 | Crook | 72/234 |
| 1,884,657 | 10/1932 | Gerlinger | 74/206 |
| 2,757,556 | 8/1956 | Uebing | 72/249 |
| 4,019,360 | 4/1977 | Biernot et al. | 74/249 |

FOREIGN PATENT DOCUMENTS

| | | | |
|---|---|---|---|
| 2446905 | 4/1976 | Fed. Rep. of Germany | 72/249 |

*Primary Examiner*—Lawrence J. Staab
*Assistant Examiner*—Joseph M. Rolnicki
*Attorney, Agent, or Firm*—Schwartz, Jeffery, Schwaab, Mack, Blumenthal & Koch

[57] ABSTRACT

A wire rolling mill in block form, a so-called wire block, with driving bevel gears which are disposed on a longitudinal shaft and can be selectively coupled by means of clutches with the line shaft and with slow speed supplementary drives for each driving bevel gear, each such supplementary drive becoming operational as the associated driving bevel gear is disengaged, so that shut-down drive lines for inoperative rolls are kept in rotating motion. The supplementary drives are engaged by means of axially slideable driving wheels, more particularly driving wheels of bevel gear construction, which mesh with the driving bevel gears in driving connection only when the associated clutch is disengaged.

6 Claims, 2 Drawing Figures

WIRE ROLLING MILL IN BLOCK FORM, A SO-CALLED WIRE BLOCK WITH AT LEAST ONE DRIVEN LINE SHAFT

BACKGROUND OF THE INVENTION

The invention relates to a wire rolling mill in block form, a so-called wire block, with at least one driven line shaft from which transverse shafts are branched off via bevel gear transmissions to drive the roll stands and the driving bevel gears are supported on the shaft so as to be freely rotatable and can be selectively coupled to the line shaft by means of clutches. A wire rolling mill of this kind is described in the German Offenlegungsschrift 24 46 905 and offers the advantage that stands or part rolls can be progressively shut down, irrespective of any increase in the rotational speed of the line shaft when larger cross-sections are being rolled, without however, eliminating vibration problems in the region of the roll drives which are not required.

Since natural vibrations cannot be avoided in a multi-section drive system of a wire rolling mill in block form of the kind described hereinbefore, there is a risk that shock marks are produced as a result of such natural vibrations in the bearings and on the teeth of stands which are shut down and are therefore stationary. Such shock marks can cause irregular running within the branched drive and this becomes progressively serious the longer a shut-down stand section is exposed to the shock markings resulting from the natural vibrations of the co-rotating drives. This irregular running can be detrimental for the rolled stock.

SUMMARY OF THE INVENTION

It is therefore the object of the invention to avoid shock marks on shut-down, branched drives for stand sections or part rolls. The problem is solved in that the driving bevel gears, which are loosely supported on the line shaft, can be driven by slowly rotating supplementary drives each of which comprises a driving wheel which drivingly engages with the associated bevel gear by axial motion and safety means are provided to prevent the axial motion of the slowly rotating driving wheels if the associated clutch for the driving bevel gear is engaged and prevents engagement of the clutch if the slowly rotating driving wheel is drivingly coupled to the bevel gear. This ensures that the bevel gear assembly and the transverse shafts of a stand section or of a pair of part rolls slowly rotate constantly when they are disengaged from the line shaft. It is perfectly feasible for the slowly rotating driving wheels to be also constructed as bevel gears which mesh with the associated bevel gear on the line shaft by means of axial motion. However, it is preferable for each of the slowly rotating driving wheels to be constructed as friction wheels of bevel gear configuration on cantilevered supports, whose drive shafts, extending transversely to the line shaft, can be axially disengaged from the bevel gear against the persistent force.

Mutual blocking of the operations for coupling the slowly rotating driving wheel as well as the clutch is conveniently ensured by the control lever of the clutch and the control lever of the supplementary drive being coupled to each other so that both coupling operations are necessarily performed in opposite senses.

BRIEF DESCRIPTION OF THE DRAWINGS

One exemplified embodiment of the invention is illustrated in the accompanying drawing in which.

DETAILED DESCRIPTION OF THE PREFERRED EMBODIMENT

Figure 1:
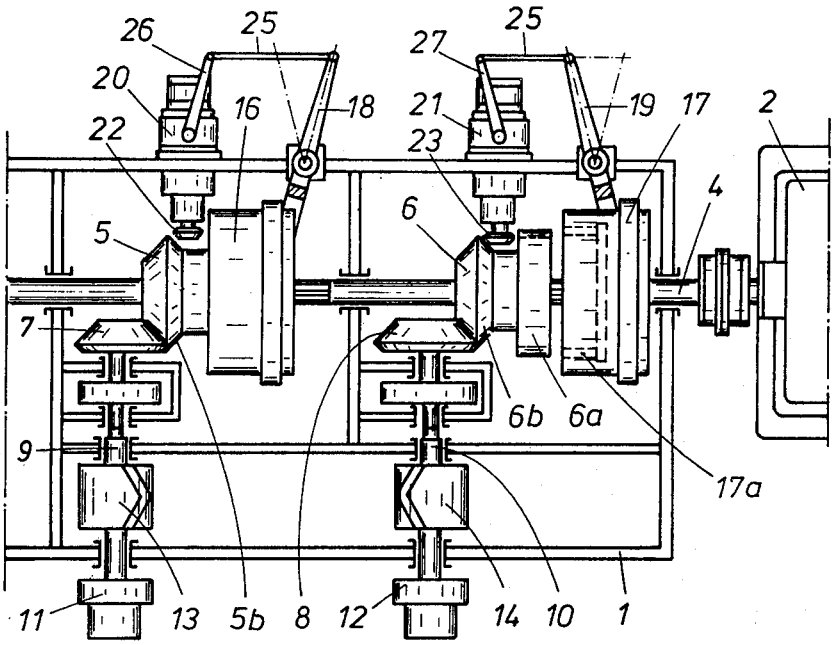
FIG. 1 shows the two last stand sections of a wire block with their selectively disengageable drives in a longitudinal section through the bearings, otherwise as a front view and FIG. 2 a slowly rotating supplementary drive to an enlarged scale as a longitudinal section.

The wire block comprises a casing 1 with a line shaft 4 supported therein and driven on the exit side via a back-gear transmission 2 by a variable-speed d.c. motor, not shown. Driving bevel gears 5, 6, in constant mesh with driven bevel gears 7, 8, are supported on the line shaft 4 so as to be freely rotatable. The bevel gears 7, 8 drive transverse shafts 9 and 10, the ends of which support cantilevered top roll sections 11 and 12. The roll sections situated therebelow are mounted on additional transverse shafts, not shown, which are coupled to each other by means of counter-rotating pinions 13 and 14. Corotating clutch sleeves 16, 17 are provided on the line shaft 4 and are slideable by means of hand levers 18, 19 on the line shaft 4 which is provided with splining. Each clutch sleeve 16, 17 is provided with internal teeth, for example 17*a,* which can be engaged or disengaged with external teeth 6*a* of the bevel gears 5 or 6. It can be seen that the clutch sleeve 17 is disengaged and the associated bevel gear 6 is uncoupled and the stand section with the roll 12 is shut down. The clutch sleeve 16, on the other hand, is engaged and entrains the bevel gear 5 so that the stand section with the roll 11 is in operation.

Each bevel gear 5 or 6, which is freely rotatable on the line shaft 4, is associated with a supplementary drive 20, 21 with axially adjustable friction wheels 22, 23 of bevel gear configuration. It can be seen that the friction wheel 22, associated with the bevel gear 5, is set in the upward direction while the friction wheel 23 of the supplementary drive 21 is engaged with the conical collar 6*b* of the bevel gear 6. The supplementary drive 21 therefore enables the uncoupled and freely rotatable bevel gear 6 to rotate slowly. The branched drive 8, 10 and 14 for the roll pair 12, which is actually shut down, being the last stand, therefore also rotates. To ensure alternating actuation of the supplementary drives 20 or 21 by means of the associated clutch sleeves 16 or 17, the control levers 18 or 19 are connected via coupling rods 25 to the control levers 26, 27 of the supplementary drives 20, 21 so that, for example, if the clutch sleeve 16 is engaged the friction wheel 22 is lifted off the conical mating surface 5*a* of the bevel gear 5 and vice versa can be engaged for frictional contact only if the clutch sleeve is disengaged from the bevel gear which applies to the clutch sleeve 17 and to the friction wheel 23.

Figure 2:
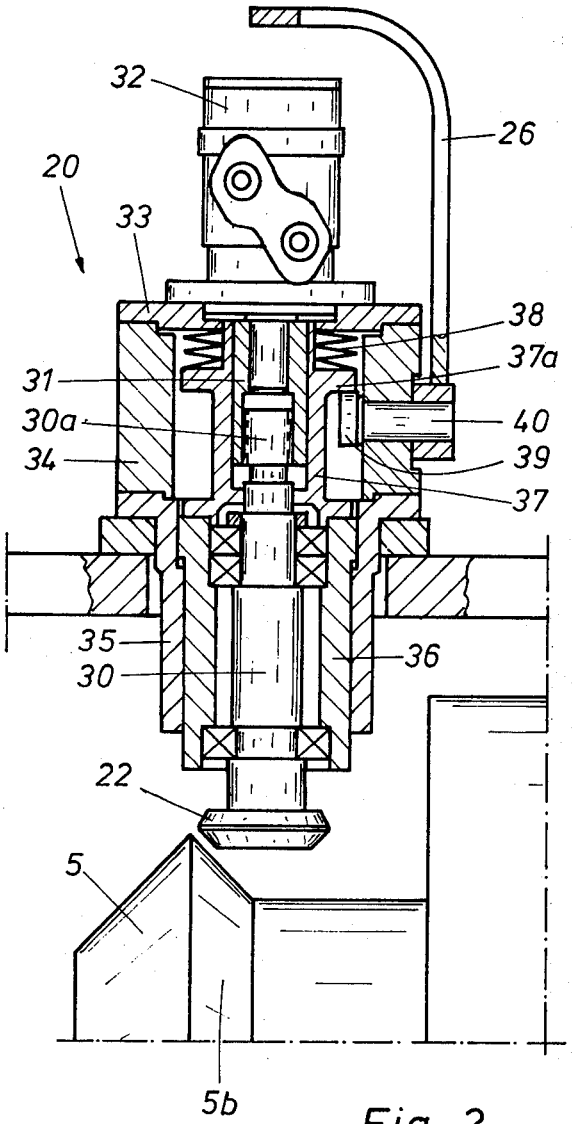

FIG. 2 shows the supplementary drive 20 for the bevel gear 5 as an enlarged view and in section but rotated through 90° with respect to the arrangement of the control lever 26. The slowly rotating driving wheel of the supplementary drive 20 is constructed as a friction wheel 22 of bevel gear configuration with a cantilever support disposed on a drive shaft 30 which extends transversely to the line shaft 4. The drive shaft 30 has a splined end 30*a* which meshes with a bush 31 which is provided with internal teeth and is driven by a hydraulic motor 32. The hydraulic motor is flange mounted on a casing cover 33 which covers a cylindrical casing 34 with a cylindrical external bush 35.

The drive shaft 30 is supported within an axially adjustable bush 36, 37 comprising two parts of which the upper part 37 of the bush supports a collar 37*a* as an abutment for a compression spring 38 which bears on the casing cover 33. Axial adjustment of the bush 36, 37, which is prevented against co-rotation, and of the drive shaft 30 is performed by an adjustable eccentric 39, associated with an adjusting spindle 40 which is supported tranversely to the adjusting direction of the drive shaft 30 in the casing shell 34 and can be adjusted by the hand lever 26. The collar 37*a*, which is biased by the force of the spring 38 and is associated with the bush part 37 bears upon the adjusting eccentric 39, so that depending on the position thereof the slowly rotating friction wheel 22 bears drivingly on the conical mating surface 5*b* of the bevel gear 5 or is in the idling position illustrated in FIG. 2.

What I claim is:

1. A wire rolling mill comprising:

a driven line shaft;

a plurality of driving bevel gears freely rotatably mounted on said driven line shaft;

a plurality of clutch means associated respectively with said driving bevel gears for selectively coupling said associated driving bevel gears to said driven line shaft;

a plurality of driven bevel gears meshed respectively with associated ones of said driving bevel gears;

a plurality of driven stand shafts connected to associated ones of said driven bevel gears, whereby actuation of one of said clutch means causes an associated driving bevel gear, driven bevel gear and driven stand shaft to rotate at a first speed;

a plurality of supplementary drive means associated with respective ones of said driven stand shafts for rotating the associated driven stand shaft at a second speed, lower than said first speed, when actuated; and a plurality of safety means associated with respective ones of said clutch means and associated supplementary drive means for disengaging a clutch means when the associated supplementary drive means is actuated and disengaging a supplementary drive means when the associated clutch means is actuated.

2. A wire rolling mill as claimed in claim 1, wherein each of the supplementary drive means incudes a slowly rotating driving wheel having a beveled driving surface, a mating beveled drive surface on the associated driving bevel gear, and means for moving the beveled driving surface of each driving wheel into and out of engagement with the beveled driving surface on the associated driving bevel gear.

3. A wire rolling mill as claimed in claim 2, wherein each driving wheel is mounted on an associated drive shaft supported in an associated axially adjustable bush and each drive shaft is driven via splining by a bush which has internal teeth and is driven by a hydraulic motor, and a compression spring is disposed to produce a force to move the axial adjustable bush.

4. A wire rolling mill as claimed in claim 3, wherein each axially adjustable bush is provided with a collar, and including an adjustable eccentric connected to said collar to act against the force exerted by the compression spring and a control lever for rotating said adjustable eccentric.

5. A wire rolling mill as claimed in claim 1, wherein each clutch means includes a control lever and each supplementary drive means includes a control lever, and each safety means comprises the control lever of a clutch means and the control lever of the associated supplementary drive means being connected to each other.

6. A method of preventing shock marks from forming on the bearings and teeth of driving shafts and gears associated with inoperative stands in a wire rolling mill having a plurality of stands and at least one driven line shaft from which transverse shafts for operating said stands are driven selectively through bevel gear transmissions, wherein the bevel gear transmissions are selectively connectable to the driven line shaft through clutches, said method comprising:

driving at least one of said transverse shafts at a first speed by connecting said at least one transverse shaft to said driven line shaft through a clutch;

driving the transverse shafts which are not connected to the driven line shaft with supplementary drives at a second, lower speed; and disconnecting any transverse shaft from the supplementary drive immediately upon connecting that same transverse shaft to said driven line shaft through one of said clutches and disconnecting any transverse shaft from the driven line shaft immediately upon connecting that same transverse shaft to said supplementary drive.

* * * * *